United States Patent [19]

Fritjof

[11] Patent Number: 4,484,435

[45] Date of Patent: Nov. 27, 1984

[54] METHOD AND DEVICE FOR THE PRODUCTION OF TEXTILE FIBRE YARNS

[76] Inventor: Maag Fritjof, Fasanenstrasse 31, D-6233 Kelkheim/Taunus, Fed. Rep. of Germany

[21] Appl. No.: 361,911

[22] PCT Filed: Feb. 28, 1981

[86] PCT No.: PCT/EP81/00078

§ 371 Date: Mar. 12, 1982

§ 102(e) Date: Mar. 12, 1982

[87] PCT Pub. No.: WO82/00304

PCT Pub. Date: Feb. 4, 1982

[51] Int. Cl.[3] ..... D02G 3/04; D02G 3/38

[52] U.S. Cl. ..... 57/315; 57/6; 57/18; 57/310; 57/281

[58] Field of Search ..... 57/3, 6, 18, 266, 267, 57/270, 279, 281, 310, 315, 316, 264, 268; 19/0.43, 0.46

[56] References Cited

U.S. PATENT DOCUMENTS

| | | | |
|---|---|---|---|
| 2,044,130 | 6/1936 | Sowter | 19/0.46 X |
| 3,435,606 | 4/1979 | Roebuck | 57/315 X |
| 3,646,745 | 3/1972 | Baldwin et al. | 57/315 |
| 3,835,639 | 9/1974 | Rhyne | 57/2 |
| 4,018,042 | 4/1977 | Maag et al. | 57/18 X |
| 4,019,691 | 4/1977 | Wroclowski et al. | 57/264 X |
| 4,120,526 | 10/1978 | Rohner | 57/268 X |
| 4,164,837 | 8/1979 | Maag et al. | 57/3 |
| 4,226,077 | 10/1980 | Hilbert | 57/18 |
| 4,299,083 | 11/1981 | Igel et al. | 57/18 |

*Primary Examiner*—Donald Watkins

*Attorney, Agent, or Firm*—Julian W. Dority

[57] ABSTRACT

A method is disclosed in which a silver (2) of textile fibers is drawn in a drawing mechanism (3), strengthened in a wrapping unit (4) by wrapping with a fine filament yarn into a roving (5) and the latter is drawn in the drawing mechanism (11, 12) of a spinning machine down to the desired yarn thickness. Rupture of the filament yarns in the drawing mechanism of the spinning machine takes place not in the predrawing zone but only in the main drawing zone. For wrapping of the roving a filament yarn is employed, the tension in which at an elongation of 4% amounts to at least 10 N and the ultimate strength of which amounts at most to 100 cN, and in which the ratio of elastic elongation to total elongation at a loading of 15 CN does not fall below the value of 80%. The wrapping unit (4) is surrounded with a stationary casing one half (45*a*) of which may be swung out. After the swinging out the complete hollow spindle (42) together with its bearing (44) and bobbin (43) with the filament yarn for wrapping may be removed. The roving are wound in precision winding on a bobbin (7) by a driving roll. The bobbins are then conveyed overhead in a container made as an unwinding creel (9) to the spinning machine and there brought into working position.

10 Claims, 5 Drawing Figures

Figure 1:
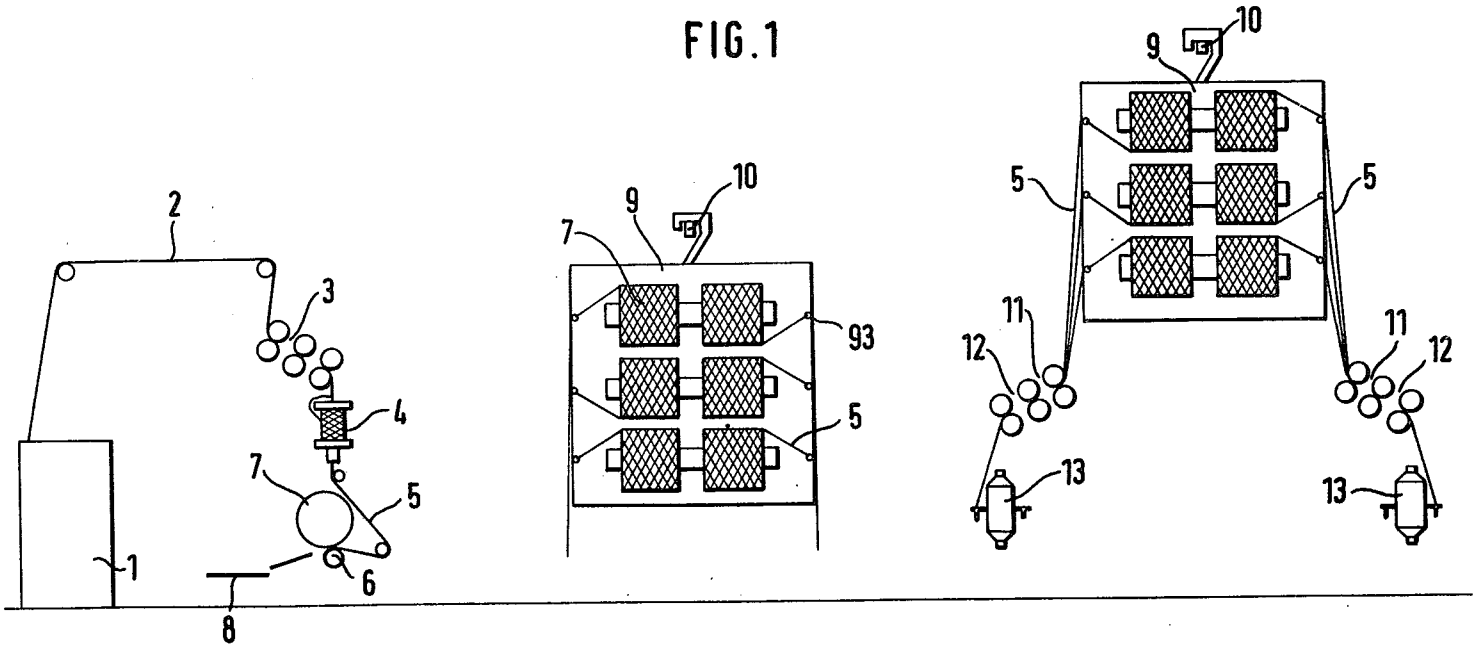

FIG. 3
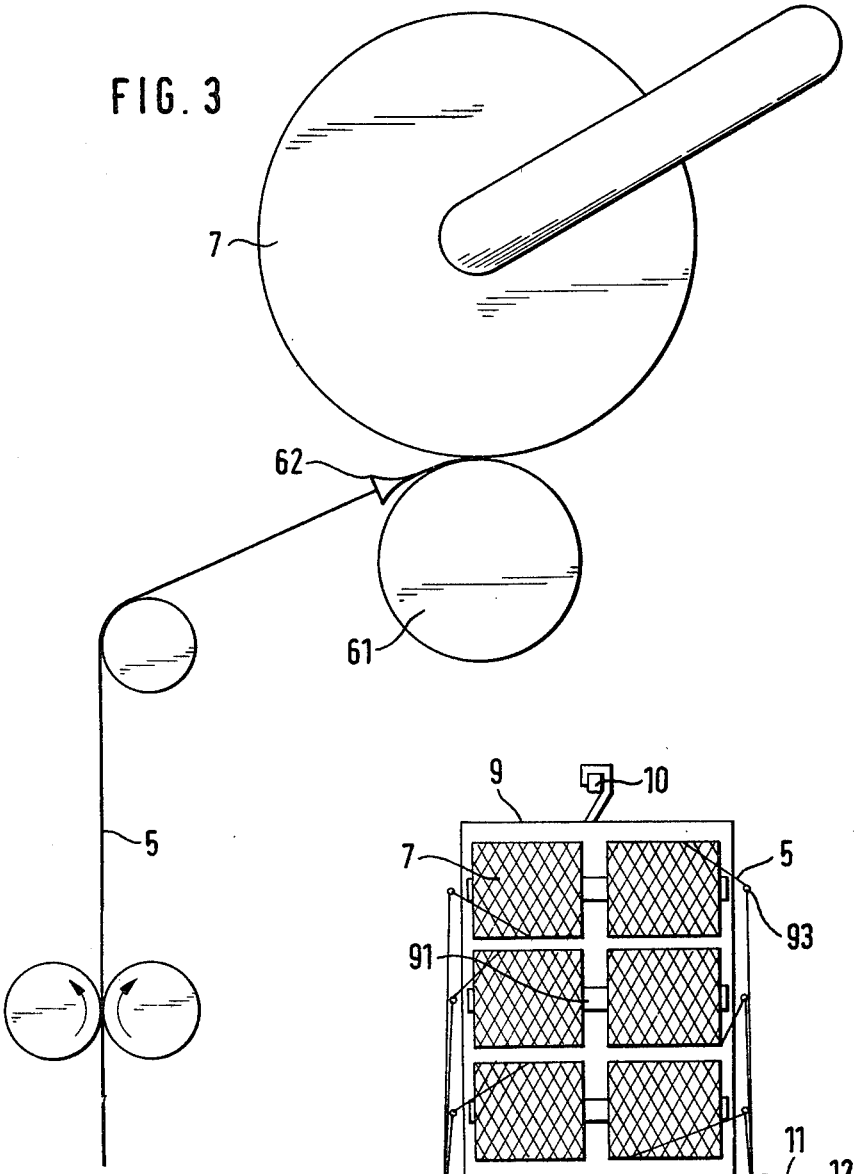
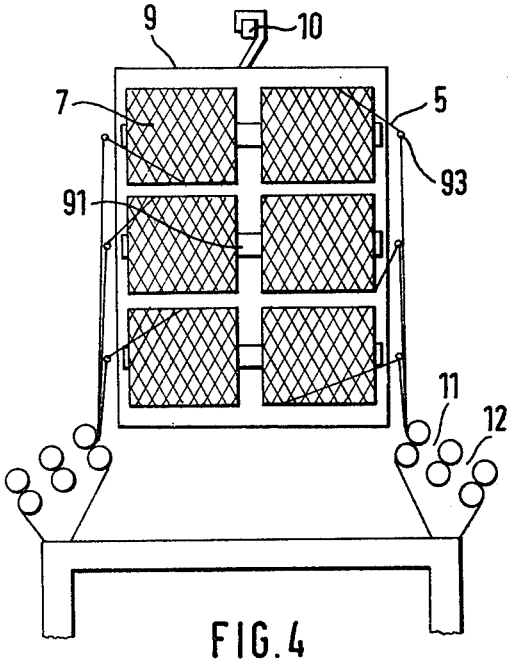
FIG. 4

METHOD AND DEVICE FOR THE PRODUCTION OF TEXTILE FIBRE YARNS

The invention refers to a method of production of yarns from sliver of textile fibres and its attenuation into roving, where the latter is strengthened by wrapping with a fine filament yarn, drawing of the roving in the drawing equipment of a spinning-machine down to the required yarn thickness, and strengthening of the fibre ribbon which arises in doing so, e.g., by imparting twist, as well as a device for the performance of the method.

A roving capable of being drawn, produced by wrapping with a filament yarn, is described in the West German No. P 24 47 715. As the prerequisite for satisfactory drawing characteristics it is mentioned in it that the elongation at rupture of the enwrapping filament yarns must be extraordinarily low and also a definite geometrical arrangement of the filament yarns in the roving is necessary.

Rupturing the filament portion in the pre-drawing zone suggests itself, since then a fibre ribbon is fed to the main drawing zone, which may be drawn completely unimpeded. Through the examples quoted in the patent specification the possibility of pursuing this course is described.

Moreover if the elongation at rupture of the enwrapping filament yarn is higher than specified in the example of the West German No. P 24 47 715, an alteration of the geometrical arrangement of the enwrapping filament yarn in the roving as is caused, e.g., by an alteration in the balloon tension during wrapping, may prevent uniform rupture of it. This then leads to trouble in drawing in the main drawing zone.

Greater pre-drawing might in this case lead again to more uniform rupture of the filament yarns. But it has been established that the uniformity of the yarn thereby becomes impaired.

The production of filament yarns having the low elongation at rupture necessary for roving of that kind is described in the West German O/S No. 26 14 523. This way is not simple technically and above all is loaded with additional costs which make more difficult an economical application of rovings wrapped with filament yarns.

A method of production of yarns for wrapping, which in principle is suitable also for the production of wrapped rovings, is described in the West German A/S No. 24 28 483. For improvement of the course of the process as regards quality of yarn and thread breakage but also for the saving of energy, various executions of the wrapping unit are described in the patent literature.

Thus in the West German O/S No. 28 33 326 it is proposed to surround the hollow spindle and bobbin of filament yarn for wrapping, with a can rotating with it, which is provided with a removable cover in the centre of which is fitted an axially adjustable thread guide tube rotating with it.

In the West German O/S No. 29 02 404 a hollow spindle is described which is surrounded by a stationary cylinder which is closed with a cover and in the interior of which prevails a raised air pressure.

The West German O/S No. 29 13 762 describes a hollow spindle which is likewise surrounded by a stationary cylinder, and the bobbin of yarn for wrapping is closed off by an arched cover.

For a satisfactory course of the process it is necessary to put the wrapping point as close as possible to the delivery mechanism for the sliver. But in the case of the stated constructions of spindle this is only possible if for the fitting or respectively removal of the bobbin with the yarn for wrapping, the axis of the hollow spindle is shifted so far that the bobbin does not come into contact with the delivery mechanism.

The removal from the hollow spindle of the bobbin with the yarn for wrapping is also made more difficult by the various casings proposed, which indeed must have only a slight clearance from the bobbin. The removable cover in addition makes more difficult the exchange of the bobbin.

Upon starting spinning or in the case of breakage of the wrap yarn the bobbin with the wrap yarn must each time be removed from the hollow spindle, the end of the yarn sought, the bobbin mounted again and the end of the yarn threaded into the hollow spindle. Although the numbers of thread breakages during wrapping are very low, the outlay upon them certainly loads the labour charges considerably.

For the production of yarns for wrapping it is advantageous to employ as the yarn for wrapping a very fine filament yarn. The search for the yarn end on the bobbin and the threading of this very fine filament yarn into the hollow spindle is not simple. The handling of fine filament yarns of that kind is unfamiliar to the operators and therefore needs special qualifications.

The state of the art is to insert the wound roving bobbins on the drawing frame into boxes, to convey these to the spinning machine, there to remove them from the boxes again and insert them into an unwinding creel above the drawing mechanism. The roving bobbins are then drawn off by rolling.

This procedure is very labour-intensive and for operation of the machines also very strenuous, since the position of the roving bobbins in the unwinding creel is ergonomically extremely unfavourable. Because of this unfavourable position of the roving bobbins and also because of the dimensions of the roving bobbins being restricted by the distribution of the spindles and the width of the machines, their weight cannot be increased as much as would be actually desirable for the rationalization of the method.

Precision winding is ideal for satisfactory and dense building up of a bobbin, as well as also for optimum run-off characteristics. This applies to a quite special degree for soft and less stable rovings.

For the winding up of material fed in at constant speed, in the case of known precision winding the speed of rotation of the bobbin is so regulated that the peripheral speed of the bobbin remains constant. As the regulating variable the thread tension picked up continuously before the winding is employed.

The technical outlay upon this is considerable and the stressing of the roving by the continuous pick-up of this tension is likewise problematical.

The problem of the present invention is to avoid the aforesaid disadvantages in the production of textile fibre yarns from wrapped rovings.

This problem is solved in accordance with the invention by methods and devices which are described in the characterizing portions of the claims.

Depending upon the method of spinning the amount of draw in the main drawing zone is about 15 to 40 times. If one now by correspondingly low drawings in the predrawing zone and higher elongation of the filament yarns for wrapping, prevents rupture of them in the predrawing zone, they rupture with certainty in the main drawing zone provided that the filament yarns get nipped securely between the cylinders of the drawing mechanism. That means that at a given elongation at rupture of the filament yarns the draw in the pre-drawing zone is set so low that the rovings in the predrawing zone do not get stretched as far as the elongation at rupture of the filament yarn. But if the draw ratios are predetermined, the filament yarns employed for the wrapping must have such a high elongation at rupture that it is reached not in the predrawing zone but only in the main drawing zone. In each case the elongation at rupture of the filaments must be the same as or greater than the predraw and less than the total draw. Through the stretching of the filament yarn in the predrawing zone the roving is uniformly collected at entry into the main drawing zone. This provides satisfactory conditions for uniform drawing.

For the method filament yarns may be employed having characteristics of variation of length with force, which are usual also for other fields of use. But quick-spun or respectively partially stretched filament yarns may be applied too.

The filament characteristics are of considerable importance for the avoidance of faulty drawing, roving breakages and scroops.

For the prevention of faulty drawing or respectively roving breakages the filament yarn for wrapping must at a loading of the roving in tension be able to build up sufficient frictional forces between its fibres for creating together with the strength of the filament yarn an adequate strength of the roving. For that purpose the filament yarn must already at low elongation develop an adequately high tension. It is therefore preferable if the behaviour as regards variation of length with force and the count of the filament yarn are so determined that in the filament yarn at an elongation by 4% a minimum tension of 10 cN is developed.

It must moreover be guaranteed that the filament yarn at the usual loading of the roving does not get loaded in the range of higher permanent elongations. This is the case when at loading of it at 15 cN the ratio of elastic elongation to total elongation does not fall below 80%.

Scroop formation or respectively slip of the filament yarn between the drawing mechanism cylinders may be prevented if in particular the delivery cylinder is loaded adequately heavily, the cylinder coating is not too hard and the rupturing force of the filament yarn for wrapping is not too high. As a limit for the rupturing force of the filament yarn, in the case of the drawing mechanism constructions of today a maximum of 100 cN may be assumed.

By the exchange of the hollow spindle including the bobbin with the yarn for wrapping together with its mounting, for another unit in which the filament yarn is already drawn into the hollow spindle, the removal of a roving breakage or the exchange of the filament bobbins may also be undertaken by less skilled labour. Furthermore the trouble can be removed considerably quicker. The machine efficiency rate is also thereby increased.

It is particularly advantageous to perform in a separate working step the preparation of the hollow spindle and bobbin of yarn for wrapping, that is, the cleaning of the bobbin, the search for the yarn end and the threading of it into the hollow spindle, if necessary also the precise setting of parts of the spindle such, e.g., as the thread guide tube in the case of the West German O/S No. 28 33 326. This work can then be performed by a few specially trained operators and for all of the machines together. It can also thereby be avoided that the operators of the drawing frames come into contact at all with the fine filament yarn which is so difficult to handle.

In the case of the device in accordance with the invention the system comprising the hollow spindle and bobbin with the yarn for wrapping is on the one hand anchored rigidly in the machine. But on the other hand the exchange of the system, e.g., upon starting spinning or even in the case of yarn breakage can easily be accomplished.

Enveloping the hollow spindle and the bobbin of yarn for wrapping, in a casing rotating with it, reduces the thread tensions in the wrap yarn during wrapping to the extent being striven for. At the same time the extent their oscillations is considerably reduced. This is favourable for the characteristics of the wrap yarn. Furthermore the consumption of energy for the spindle drive is significantly reduced. Through a cover over the rotating casing the risk of the access of fluff to the yarn balloon is reduced. By this measure the consumption of energy is additionally reduced too.

It is advantageous to produce the rotating casing out of a fibre-reinforced plastics. The weight of this part can thereby be reduced. This is advantageous for the high speed of rotation of the spindle desired for economic reasons.

If the fibre reinforcement of the rotating casing consists of appropriately wound fibre cords of high strength and of high modulus of elasticity such as, e.g., glass fibres and to a particular extent also carbon fibres have, the characteristics of strength and elasticity may be further improved with a low weight of the casing.

For the winding of a yarn being fed in at constant speed it is advantageous to drive the bobbin at its periphery by a driving roll. The bobbin thereby obtains independently of its diameter practically the same peripheral speed as the driving roll. The speed of rotation of the bobbin on the contrary alters in dependence upon the bobbin diameter reached.

For the building up of the bobbin the yarn which is to be used for wrapping is laid in the axial direction in accordance with certain laws. As the guide member for that purpose, e.g., a traversing thread guide may be employed. Its drive may be effected by, e.g., eccentric, cam disc, reversing thread shaft, or else a threaded spindle which changes the direction of rotation.

For a precision winding the bobbin ratio, that is, the ratio between the number of double strokes of the traversing thread guide and the speed of rotation of the bobbin must be constant. Since the speed of rotation of the bobbin is changing continuously, the drive of the traversing thread guide must be coupled to the rotation of the bobbin. A mechanical coupling needs for that purpose a relatively large amount of power which must be applied via the drive of the bobbin by means of the driving roll. This may lead to a slip between the driving roll and the bobbin which is too high for the sensitive roving and thereby cause damage to the yarn.

An electrical coupling is therefore advantageous between the bobbin and the traversing thread guide. Many possibilities are offered today for that purpose. One can, e.g., convert the speed of rotation of the bobbin via a tachometer into an electrical quantity and thereby, e.g., regulate the speed of rotation of a d.c. motor via a potentiameter. This then drives the traversing thread guide.

But one can also generate via the rotation of the bobbin electrical pulses and thereby energize a stepping motor which in turn drives the traversing thread guide.

Absolute constancy of the bobbin ratio cannot be achieved in the case of every regulating system. But the economically logical accuracy of regulation is adequate for being able to deal completely with all of the advantages of a precision winding.

The bobbin ratio may be varied relatively simply through appropriate alterations of the regulator. The build-up of the bobbin is thereby adapted to an optimum extent to the material which has to be handled.

It may be advantageous to change the bobbin ratio during the winding of a bobbin so that the reduction in the zigzag is compensated with the growing diameter of the bobbin. The alteration of the bobbin ratio is advantageously effected in steps so that integral ratios may be avoided. The signal for an alteration of the bobbin ratio may in that case originate from the winding diameter or from the speed of rotation of the bobbin. It is particularly advantageous to change over the bobbin ratio to the next step via an adjustable minimum speed of rotation of the traverse drive.

For the production of a bobbin in parallel winding in which, that is, during one revolution of the bobbin the yarn is shifted by about its own diameter and as because of the high packing density thereby achievable it is especially for rovings that it is readily employed, the drive via a threaded spindle which in turn is driven by a stepping motor, is of particular advantage. At the end of the stroke provided for, the direction of rotation of the stepping motor may be reversed. In that case the stroke of the traversing thread guide may be altered in dependence upon the diameter of the winding or upon the number of the layers of yarn which have been wound on. Conical end faces of the bobbins are thereby obtained and the dropping off of individual layers is prevented.

The occurrence of waste may be avoided if the full roving bobbin is changed with the spinning unit stationary. The stopping of each individual spinning unit is structurally very costly. Consequently it is to be recommended that for the change of bobbin the whole machine be brought to rest and started up again after the change of bobbin. This method of running offers the additional advantage that the motion of the traversing thread guide may be controlled centrally. It then only needs the speed of rotation to be taken off one master bobbin in order to control all of the traversing thread guides.

The very high productivity of the method leads to short running times of the bobbins. This offers a satisfactory prerequisite for an economically logical mechanisation of the change of bobbin. A travelling doffer which travels from unit to unit during the standstill of the machine, certainly needs for the change of all of the bobbins considerably more time than a stationary doffer and consequently leads also to a lower efficiency rate. But in the assumed scope for the production per spinning unit, the bobbin weight and the values logical because of the production per machine, for the number of units per machine, a travelling doffer works more cheaply than a stationary doffer.

If the roving bobbins are treated directly out of the conveyor container in which they have been brought from the drawing frame to the spinning machine, the mounting of the roving bobbins on the spinning machine may be saved.

It is particularly advantageous to make the conveyor container as an unwinding creel. On the drawing frame the creel may be brought into a position which is an optimum ergonomically for the mounting. It is then also easily possible to mount the roving bobbins in a number of stages and thereby to gain space for larger bobbin diameters.

Because of the comparatively high strength of wrapped rovings the working-off even of bobbins having a very great weight is possible by rolling off in the conventional way. But through winding in a precision cross-winding, drawing off overhead is also possible. The bobbins may thereby be arranged particularly favourably in the creel. Covering over of the unwinding creel may prevent coating of the roving bobbins with the fibre dust which exists abundantly round spinning machines, or indeed reduce it so far that the blower usually employed for the prevention of these coatings may be omitted.

The unwinding creel with the roving bobbins mounted in it is brought e.g. by means of a stacker to the spinning machine and there brought into the working position instead of the permanently mounted unwinding creel. But advantageously the charged unwinding creel may be suspended in a conveyor device which lies in the space above the machine, and brought via appropriately positioned guides into the foreseen position at the spinning machine. The unwinding creel in that case remains suspended on the conveyor device and is not connected rigidly to the spinning machine. The frame of the spinning machine is thereby relieved of load in spite of the heavy weight of the bobbins.

With the aid of the Figures and embodiments below the method and the devices for the performance of the method are explained in still greater detail.

FIG. 1 illustrates diagrammatically the course of the method.

The sliver (2) of textile fibre is fed from a storage container (1) to the drawing system (3) of a drawing frame. The sliver of textile fibre attenuated in the drawing system is then guided through a wrapping device (4) and in doing so is wrapped with a filament yarn. The roving (5) which thereby arises is brought by means of the winding mechanism (6) onto the bobbin (7). With the roving bobbin full the drawing frame is stopped, the roving bobbins are changed mechanically, the full bobbins are brought by means of a conveyor belt to one end of the machine and collected there and the drawing frame is started up again.

The roving bobbins (7) are mounted in an unwinding creel (9), the rovings (5) being drawn into the thread guides (93). The unwinding creel (9) is brought by the conveyor device (10) to the spinning machine and there brought into working position between the drawing mechanisms (11,12). The rovings are now led through the predrawing zone (11) and the main drawing zone (12) of the drawing mechanism. Depending upon the kind of fibre this drawing mechanism may be constructed as a nip roller system or as a draw-through drawing mechanism. In the main drawing zone (12) the filament yarn wrapping the roving gets ruptured during the drawing of the roving and the latter is drawn to the desired fineness. By means of the twisting mechanism (13) the yarn obtains its twist and is then wound onto cops.

Figure 2:
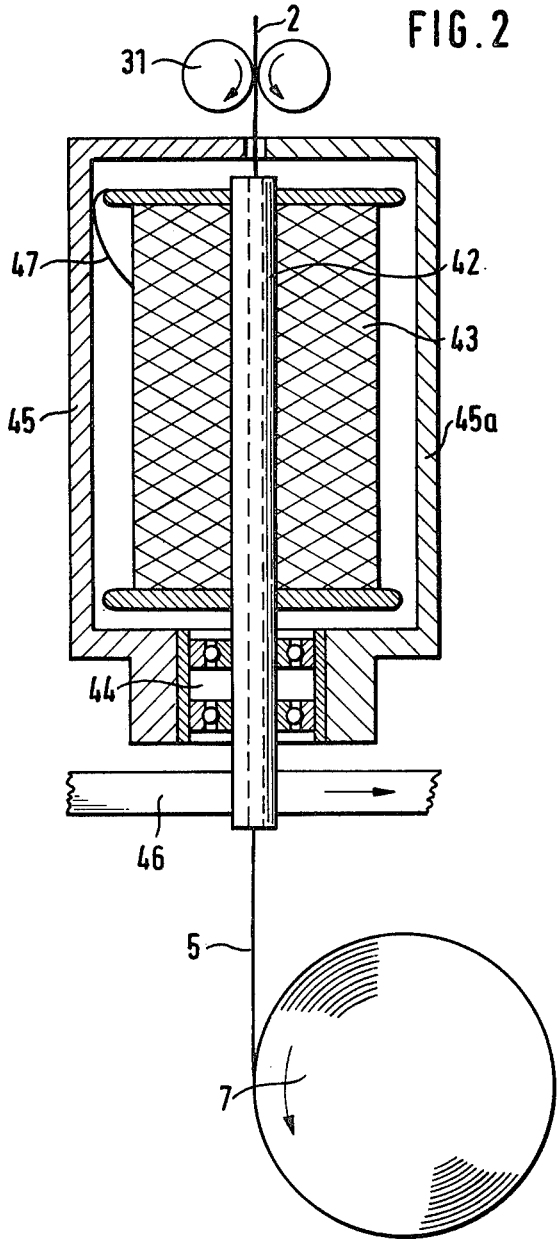
Figure 2A:
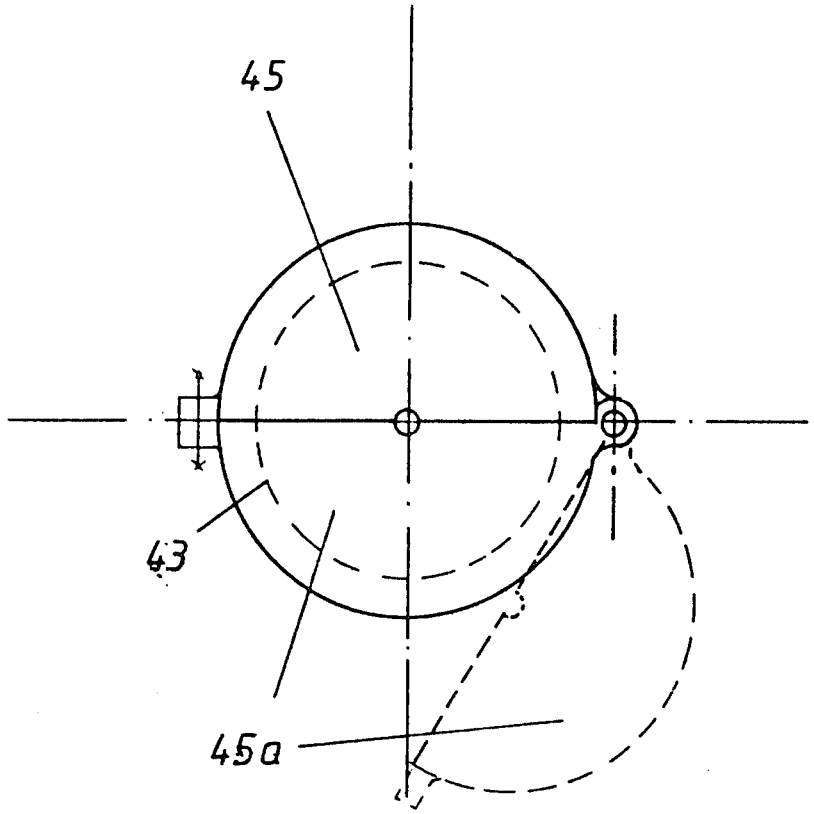

FIGS. 2 and 2*a* show the special construction of a wrapping mechanism.

The sliver (2) is fed by the pair of delivery cylinders (31) of the drawing mechanism (3) to the hollow spindle (42). The hollow spindle is moreover driven by a tangential belt (46). The bobbin with the yarn (43) for wrapping is connected fixedly in rotation to the hollow spindle. At the inlet to the hollow spindle the wrap yarn (47) is brought together with the sliver and in doing so the latter is wrapped round because of the rotation of the spindle. The roving (5) thereby formed is wound onto the bobbin (7).

The hollow spindle (42) and filament bobbin (43) are surrounded by a stationary casing (45, 45*a*) which may be swung out. One half is connected rigidly to the spindle rail which is not indicated in the Figure. The bearing (44) of the hollow spindle is with the casing closed, clamped rigidly between the halves of the casing. By hingeing the casing the hollow spindle (42) together with the bearing (44) and bobbin (43) may be removed from the machine.

FIG. 3 shows a special execution of the winding mechanism.

The roving (5) is wound onto the bobbin (7). For that purpose the bobbin is driven at its periphery by the driving roll (61). The motion of the traversing thread guide is effected by a reversing thread shaft (not shown). The speed of rotation of the bobbin (7) is picked up by a tachometer and converted into an electrical quantity. By this quantity the speed of rotation of the reversing thread shaft and thereby the lifting movement of the traversing thread guide is controlled in such a way that the bobbin ratio, that is, the ratio between the number of double strokes/min. and the bobbin r.p.m., remains constant over the build-up of the bobbin.

FIG. 4 shows the conveyor container made as an unwinding creel.

The roving bobbins (7) are supported on stationary bobbin-receivers (91). The unwinding creel (9) itself is suspended on a rail (10) which serves at the same time for the conveyance of the creel between the drawing frame and the spinning machine.

The roving (5) is drawn off the roving bobbins (7) overhead. In doing so a run-off aid can facilitate the run-off from the bobbin. The roving is led out of the unwinding creel via thread guide members (93). At the drawing frame the wound roving bobbins are inserted into the unwinding creel. The rovings are passed into the guide members so that the operators of the spinning machine can easily catch the ends of the roving after the positioning of the unwinding creel and draw them into the drawing mechanism.

EXAMPLE 1

A sliver of cotton fibres of thickness 700 dtex is wrapped with a filament yarn of the thickness 9 dtex and 20% elongation at rupture, into the roving. This roving is drawn in a drawing mechanism down to the fineness 200 dtex and strengthened into yarn by twisting. The predrawing was 1.5 times. The filament yarn for wrapping ruptured for the greater part in the predrawing zone but short periods of time were also observed in which the roving was merely stretched in the predrawing zone. This led to drawing troubles with thick and thin places in the yarn.

EXAMPLE 2

The roving from Example 1 is drawn in a drawing mechanism down to the fineness 200 dtex and strengthened into yarn by twisting. The predrawing was 1.16 times. In doing so the roving was merely stretched in the predrawing zone. The width of the roving at entry into the main drawing zone was clearly less than in Example 1 and very constant. The filament yarn ruptured only in the main drawing zone. No drawing troubles of any kind were observed in that case.

EXAMPLE 3

In a spinning machine for synthetic filament yarns the yarn was spun at a speed of 4500 m/min. and wound up onto a cylindrical bobbin driven at its periphery by means of a driving roll. The sleeve diameter of the bobbin amounted in that case to 85 mm, the outer diameter of the full bobbin was 350 mm. The bobbin receiver is connected to a tachometer which via a potentiometer regulates the speed of rotation of a d.c. motor in such a way that its speed of rotation lies in a fixed ratio to the speed of rotation of the bobbin. The d.c. motor is in turn connected to a reversing thread shaft in the groove in which runs the traversing thread guide. The bobbin ratio in that case amounted to 1/5.

EXAMPLE 4

According to the method in accordance with the German Pat. No. 24 47 715 rovings of the thickness 700 dtex are produced. The speed of delivery amounts in that case to 300 m/min. The roving is wound up onto bobbins which are driven at their periphery by means of a driving roll. All of the bobbins in one machine are changed simultaneously so that the respective winding diameters are about the same. The speed of rotation of a master bobbin is picked up by a pulse transmitter. The pulses control a stepping motor which in turn is connected to a threaded spindle and which moves the traversing thread guide. The transmission is so chosen that the traversing thread guide moves 3.5 mm during one revolution of the bobbin.

For reversal of the stroke the direction of rotation of the stepping motor is reversed. At each reversal the stroke of the traversing thread guide is shortened by 2 mm.

I claim:

1. A method of production of yarns from sliver of textile fibres, in which first of all the textile fibre sliver is attenuated into roving and said roving is wrapped with a fine filament yarn, whereupon the wrapped roving is drawn in a drawing system having a predrawing zone and a main drawing zone and subsequently strengthened such as by imparting twist, characterized in that the filament yarns with which the roving is wrapped are ruptured not in the predrawing zone but in the main drawing zone.

2. A method as in claim 1, characterized in that at a given elongation at rupture of the filament yarns the draw in the predrawing zone is set so low that the roving in the predrawing zone does not get stretched as far as rupture elongation of the filament yarn.

3. A method as in claim 1, characterized in that the filament yarns have such a high elongation at rupture that at predetermined draw ratios it is reached not in the predrawing zone but only in the main drawing zone.

4. A method as in claim 2 or 3, characterized in that the elongation at rupture of the filament yarns is the same as or greater than the predraw and less than the total draw.

5. A method as in one of the claims 1, characterized in that a roving is subjected to drawing, which is wrapped with a filament yarn the ultimate strength of which amounts at most of 100 cN.

6. A method of production of yarns from sliver of textile fibres, in which first of all the textile fibre sliver is attenuated into roving and this is wrapped with a fine filament yarn, whereupon the roving is drawn in a drawing system having a predrawing zone and a main drawing zone and subsequently strengthened such as by imparting twist characterized in that a roving wrapped with said filament yarn is subjected to drawing the tension in which at an elongation of 4% amounts to at least 10 cN and in which the ratio of elastic elongation to total elongation at a loading of 15 cN does not fall below the value of 80%.

7. A method as in one of the claims 6, characterized in that the roving is drawn off the roving bobbins overhead and fed to the drawing system of the spinning machine.

8. A method of production of yarns from slivers of textile fibers in which the textile sliver is attenuated into roving, is led through a hollow spindle carrying a fine filament yarn, and in doing so gets wrapped with the filament yarn, whereupon the roving is drawn in a drawing system and subsequently strengthened such as by imparting a twist thereto, characterized in that a hollow spindle running on a bearing and carrying a bobbin filled with the filament yarn for wrapping are provided in a wrapping mechanism, said hollow spindle with its bearing and said bobbin with the filament yarn for wrapping are removed from the wrapping mechanism as a unit when said roving or filament yarn is broken or depleted, and another unit comprising a hollow spindle with a bearing and a bobbin having filament yarn for wrapping about the roving is inserted on the wrapping mechanism and the wrapping process is continued, and wherein the wrapping yarn has already been threaded into the hollow spindle when inserted onto the wrapping mechanism.

9. Apparatus for performance of the method as in claim 8 of the type which includes a source of textile fiber sliver, a drawing system for attenuating the fiber into a roving, a wrapping device in which the roving is wrapped with a filament yarn, and a winding mechanism for winding the roving onto a bobbin wherein the wrapping device includes a hollow spindle running on a bearing and having a bobbin mounted fixedly to said hollow spindle, said wrapping yarn being wound on said bobbin, said hollow spindle and bobbin unit being mounted in a stationary casing, one-half of said stationary casing being hinged such that said half of the casing can be swung out and the hollow spindle, its bearing and bobbin unit may be unitarily removed from the casing when said part of said casing has been swung out.

10. The apparatus of claim 9 including a conveyor, said conveyor comprising a container made as an unwinding creel, bobbins on which said roving are wound being supported on stationary bobbin-receivers in said container for conveyance of the bobbins between a machine producing wrapped rovings and a spinning machine.

* * * * *